United States Patent [19]

Bretschneider

[11] 4,308,671

[45] Jan. 5, 1982

[54] STITCHED-DOWN SHOE

[76] Inventor: Walter Bretschneider, Steinau-Neustall, Fed. Rep. of Germany

[21] Appl. No.: 152,679

[22] Filed: May 23, 1980

[51] Int. Cl.[3] ..... A43B 3/14; A43B 7/06; A43B 9/10

[52] U.S. Cl. ..... 36/11; 36/3 B; 36/16

[58] Field of Search ..... 36/3 R, 3 B, 14, 16, 36/11; 12/7.7

[56] References Cited

U.S. PATENT DOCUMENTS

| | | | |
|---|---|---|---|
| 3,583,080 | 6/1971 | Wagner | 36/16 |
| 3,938,265 | 2/1979 | Probstl et al. | 36/11 |
| 4,078,321 | 3/1978 | Famolare | 36/3 B |
| 4,100,685 | 7/1978 | Dassler | 36/3 B |
| 4,250,638 | 2/1981 | Linnemann | 36/11 |

*Primary Examiner*—Patrick D. Lawson

*Attorney, Agent, or Firm*—Cantor and Singer

[57] ABSTRACT

A stitched-down shoe in which the upper or the upper material has an outwardly-turned edge which is sewn directly to a base. The base has a lateral seam groove extending around the periphery thereof and near the top of the base, and pre-formed stitch holes directed essentially perpendicular to the seam groove. The upper is stitched to the base through the stitch holes. In another embodiment, air holes are provided through the shoe base to allow "breathing" and interior grooves are provided connecting the air holes.

11 Claims, 12 Drawing Figures

STITCHED-DOWN SHOE

BACKGROUND OF THE INVENTION

This invention relates to a stitched-down shoe in which the upper or the upper material has an outwardly-turned edge which is sewn directly to a base with performed stitch holes with a seam which is at least to some extent perpendicular to the stitch holes, with the stitching running in a seam groove of the shoe base. Such a stitched-down shoe is disclosed, for example, in FIG. 4 of British Pat. No. 1,258,047.

In conventional shoes, the upper in usually connected to an insole by stitching or cementing. The sole is then cemented or sewn to this insole. An example of this state of the art is British Pat. No. 865,066. Use of an insole makes the shoe relatively expensive, and stiff for walking. The connection of the upper to the insole requires, in addition, special machines, so that the production of such shoes can only take place in factories set up for this purpose.

In the shoe according to the above-cited British Pat. No. 1,258,047, the upper is directly sewn to a tread portion. The seam connecting the upper to the tread portion here runs through the tread portion and ends in a seam groove which is provided from the tread surface of the shoe base into the sole. It is a disadvantage of this embodiment that water can very easily rise up into the shoe through the seam groove and the seam, if the seam groove is not closed with a filling material. However, this makes the production of the shoe even more expensive.

British Patent Application No. 2,014,034 also describes a shoe in which the stitching edge is made substantially deeper than the upper edge of the tread portion. The danger of penetration of water into the shoe is greatly reduced in this way. The requirement for upper material is, however, considerably greater for a shoe of this construction than for other shoes, since the upper material must be brought laterally down at the tread portion as far as the stitching edge. Particularly with thick soles, such as are frequently demanded for fashion and because of the soft tread, this increased use of upper material leads to a considerable increase in the costs of production of shoes of the type of construction according to British Pat. No. 2,014,034.

It also has to be considered that the outward-directed stitching edge of the prior art shoe gives a somewhat strange appearance, so that shoes of this constructional type are often not bought, merely because of their appearance.

BRIEF SUMMARY OF THE INVENTION

The object of the present invention is to develop a stitched-down shoe of the kind described above, which is cheap to produce and can be assembled in homework, which has a pleasing appearance and in which the danger of penetration of water into the interior of the shoe is as small as possible.

This object is achieved according to the invention in that a seam groove is provided laterally in the shoe base and runs near the upper edge thereof, and the stitching holes are directed to some extent perpendicularly into the seam groove.

In the shoe according to the invention, the seam groove can run so close to the upper side of the shoe base that just sufficient material remains between the upper side of the shoe base and the seam groove, on the one hand to make sewing easy, and on the other hand to maintain enough strength. The upper does not need to be brought over the side surfaces of the shoe base to a stitching edge provided, for example, on the underside of the shoe base, so that the use of upper material is as small as possible, which is of great importance because of the constantly rising price of leather. The fact that the upper can be stitched flush to the stitching edge and no excess has to be removed in a later process also contributes to a smaller use of upper material.

Apart from the required seam groove, the design of the shoe base is completely free in the shoe according to the invention. It can, for example, be made arbitrarily thick without anything needing to be changed in the attachment of the upper to the shoe base.

In fact, because of the seam running in the lateral seam groove, the shoe receives an advantageous sporting appearance, but does not arouse the impression of a cheap mass product of little solidity.

Since the seam groove runs near the upper edge of the shoe base, no water can rise up from the street through the seam into the shoe, in contrast to shoes with the seam groove located in the bottom of the sole, as long as deep puddles are not stepped in. The seam groove has the result that the seam does not project beyond the outer contour of the shoe and thus cannot be rubbed away when the shoe is worn.

Since the foot no longer rests on an insole in the shoe according to the invention, but directly on the shoe base, electrical charge is conducted away well without any special measures being taken for this purpose.

With particular advantage, the shoe base in the shoe according to the invention is constructed as a sole shaped to the foot.

According to another favorable embodiment of the invention, the shoe base has at least partially a raised, integrated edge which guides the foot. By this means, which can particularly be cast from polyurethane without appreciable additional cost, the foot is particularly well bedded in the shoe base, so that the danger of bending over or laterally sliding away in the shoe is excluded, or at least is greatly reduced. The raised edge moreover results, during walking, in the forces acting on the seam between the shoe base and the upper being quite small.

It is also favorable for the edge to be raised in the heel region to form a heel cap, and for the heel of the shoe base to be rounded transversely of the plane of the shoe. Such a shoe is particularly suitable for automobile travelers, since on the one hand the heel of the foot is held by the heel cap directly on the shoe base and hence the upper is not subjected to forces, and on the other hand the shoe can roll well on the floorboard of the vehicle when pressing the accelerator.

The possibility of penetration of water into the shoe can be further reduced by an arrangement characterized by a raised watertight edge on the inner side of the stitching edge of the shoe base.

Another advantageous embodiment of the invention resides in an anti-microbial agent impregnated inlay sole placed in the base of the shoe, smaller than the contact surface of the foot on the shoe base. This inlay sole can oppose the formation of foot sweat. Since, however, it is smaller than the contact surface of the foot on the shoe base, the foot still has contact with the shoe base, so that electric charge can be directly conducted away.

A further, advantageous embodiment of the invention consists of the placing of an elastic, T-shaped sealing strip between the shoe base and the upper, on the stitching edge, with the stitching running through its web and with its base abutting, on its side towards the interior of the shoe, on the upper and the shoe base. This special construction of the transition between the upper and the shoe base brings about a particularly watertight shoe. The sealing strip is advantageously made of an elastic foam rubber (for example, latex) and is stitched in during hand sewing. Because of its elasticity and its shape as a T, the sealing strip completely fulfills its function as a seal when drawn tightly against the stitching edge by the stitching.

A further favorable embodiment of the invention consists in providing grooves in the shoe base on the side towards the interior of the shoe and being connected to at least one passage hole of the shoe base. This construction makes possible an air circulation in the shoe, directly to the foot. Thus the foot climate and the internal temperature of the shoe are favorably influenced. There is no unfavorable effect on the wearing comfort. In walking there even occurs in practice a pumping action which forces air into the shoe. Advantageously, the passage hole is in front of the heel of the shoe base. Hence it has no contact with the surface of the street, so that even on a wet street moisture cannot easily reach the shoe interior.

In order to also be able to make the shoe watertight in the rain, however, a further favorable embodiment of the invention is significant, in which a blind hole with a plug to close the passage hole is associated with each passage hole. In this way, a user of the shoe according to the invention always has the closure plugs for the passage holes always available, and can insert them in the passage holes when needed. Of course, it can also be appropriate to close the passage holes when the shoe is used on particularly dusty paths.

It is also appropriate for the grooves to be covered by a perforated cover sole within the shoe. The foot can then stand on a large surface, preferably of leather, but still has direct access to the air via the perforations. Furthermore, foot sweat can first be taken up by the cover sole and then be given off to the grooves and from there to the exterior via the passage holes. Thus the formation of foot sweat is countered in an optimal manner.

BRIEF DESCRIPTION OF THE DRAWINGS

There are many possible embodiments of the invention. Two of them are schematically shown in the drawing and are described below. There are shown.

DETAILED DESCRIPTION OF THE PREFERRED EMBODIMENTS

Figure 1:
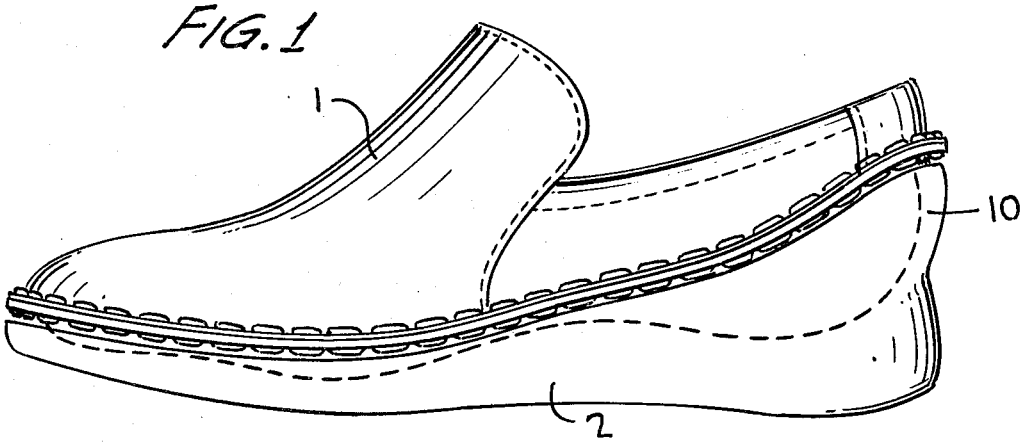
FIG. 1 is a side elevational view of a shoe constructed according to the invention.

The shoe shown in FIGS. 1–4 consists essentially of an upper 1 and a shoe base 2. The upper 1 has an out-turned edge 3, with which it abuts a stitching edge 4 of the shoe base 2. A seam groove 5 is provided beneath the stitching edge 4, laterally in the shoe base 2. Stitches 6 are directed perpendicularly through the edge 3 and the stitching edge 4 as far as the seam groove 5, as can best be seen in FIGS. 3 and 4.

Both the out-turned edge 3 and the stitching edge 4 are advantageously provided with preformed stitch holes 7, so that the stitches 6 can be made without a machine, for example, in home work.

Figure 2:
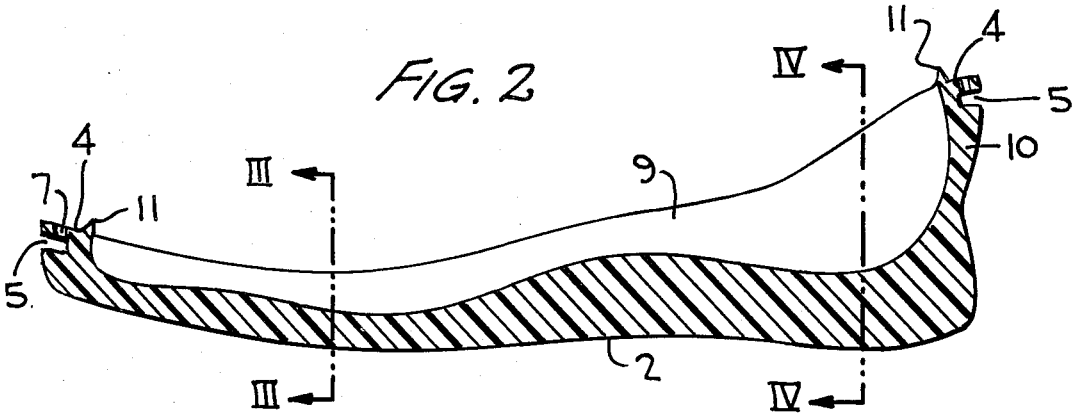
FIG. 2 is a longitudinal section through the shoe base of a shoe according to FIG. 1.

As can be seen from FIG. 2, the shoe base 2 has a raised edge 9, which is brought up in the heel region to a height such that a heel cap 10 results. This edge 9 can likewise have a tongue running around the shoe interior and forming a watertight edge 11.

Figure 3:
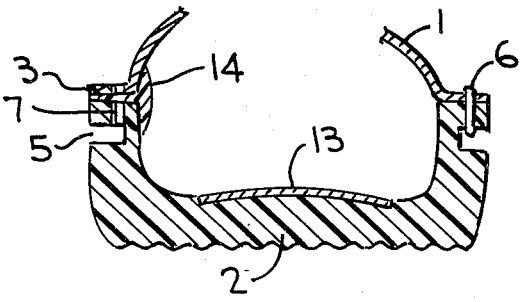
FIG. 3 is a transverse section along the line III—III of FIG. 2 with a different construction in the left-hand part of the drawing than in the right-hand part.
Figure 4:
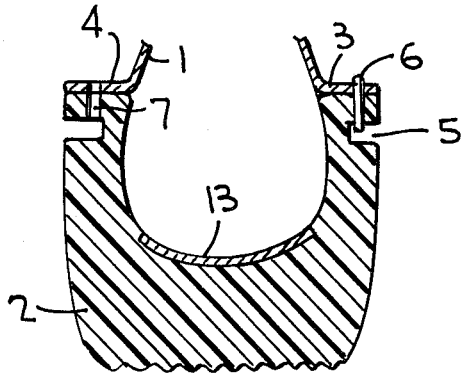
FIG. 4 is a part of a sealing strip for a shoe according to the right-hand part of FIG. 3, FIGS. 5–8 are perspective views of various shoes constructed according to the invention.

FIGS. 3 and 4 show that the seam groove 5 can run high up on the shoe base 2. The shoe base 2 engages like a ball socket around the foot, so that it is embedded well. An inlay sole 13 is laid in within the shoe base 2, but however is so small that the foot still has contact with the shoe base 2 laterally of the inlay sole 13. In this way, an electrostatic charge is conducted away well. The inlay sole 13 is impregnated with an antimicrobial agent for prevention of sweaty feet.

Figure 3A:
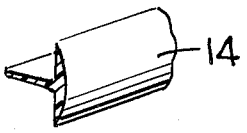
FIG. 3a is a part of a sealing strip for a shoe according to the left-hand part of FIG. 3.

FIG. 3 shows, in the left-hand part of the drawing, a sealing strip 14 which is shown in detail in FIG. 3a, and sewn in between the stitching edge 4 and the shoe base 2 by means of the stitches 6. Thus the sealing strip 14 lies with its web between the upper 1 and the stitching edge 4 of the shoe base 2. The sealing strip 14 abuts the upper 1, and the raised edge of the shoe base 2, with its base.

Figure 5:
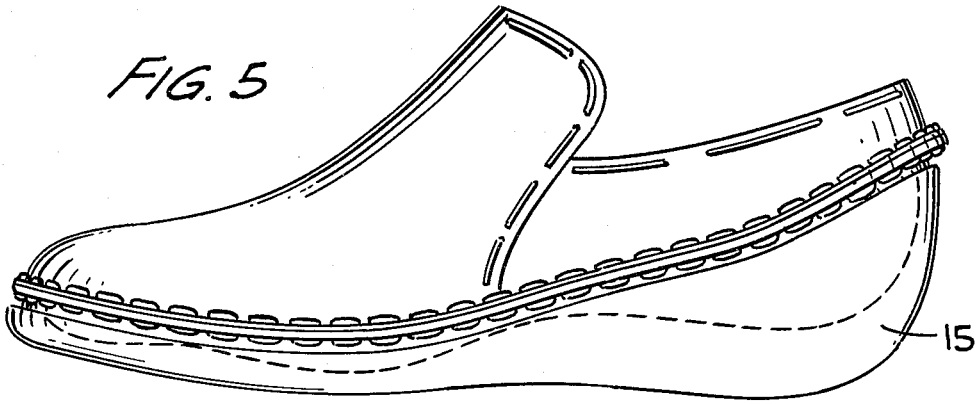

FIGS. 5 through 8 clearly show that the means according to the invention are not restricted to a particular type of shoe. FIG. 5 shows, for example, a so-called automobile traveler's shoe, with a heel 15 rounded transversely of the plane of the shoe sole, so that the shoe can roll with its heel easily on the floorboard of the car when the accelerator is pressed. The dashed line shows the foot tread with guide support.

Figure 6:
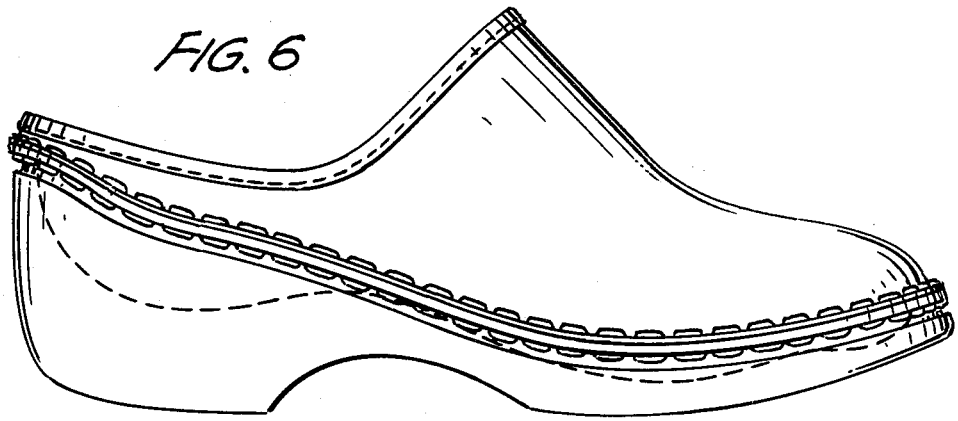
Figure 7:
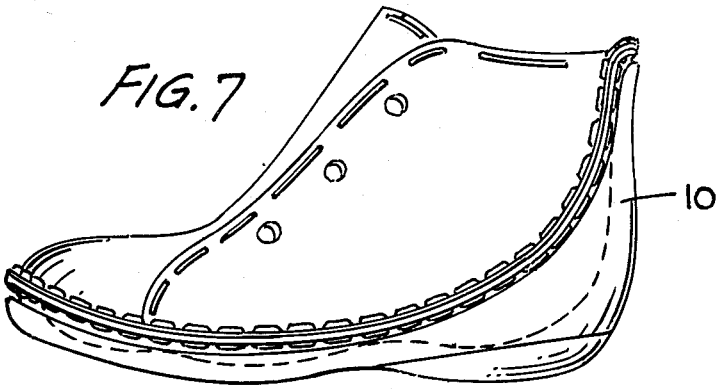

FIG. 6 shows a clog constructed according to the invention, while a so-called toddler's shoe for small children is shown in FIG. 7. In the toddler's shoe, the heel cap 10 is raised as far as the bend of the achilles tendon.

Figure 8:
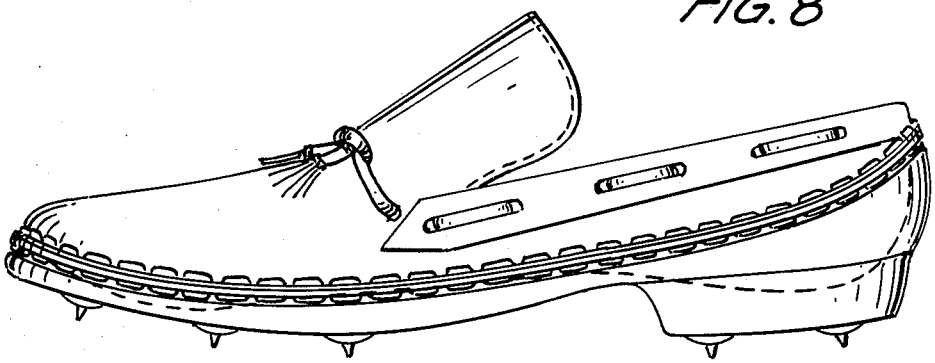

FIG. 8 shows a golf shoe which, without the spikes, would be a street shoe.

Figure 9:
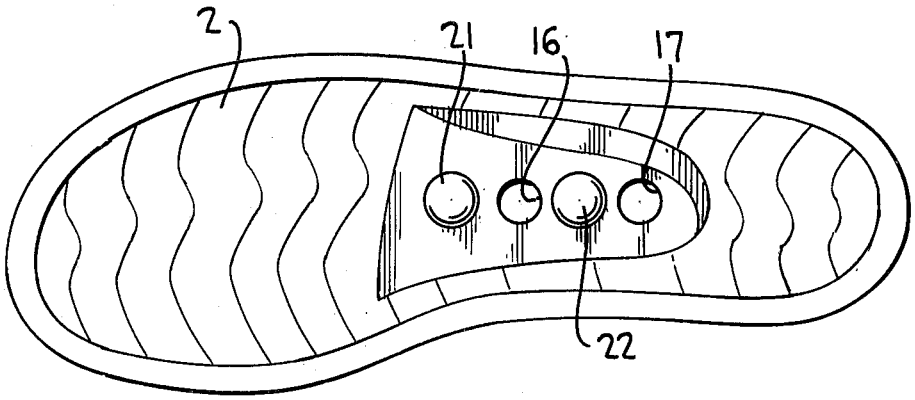
FIG. 9 is a view from below of a specially shaped shoe base.
Figure 10:
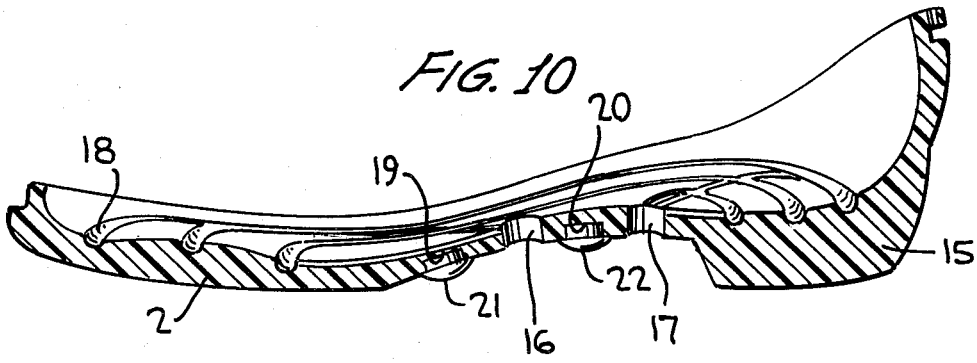
FIG. 10 is a longitudinal section through the shoe base of FIG. 9.
Figure 11:
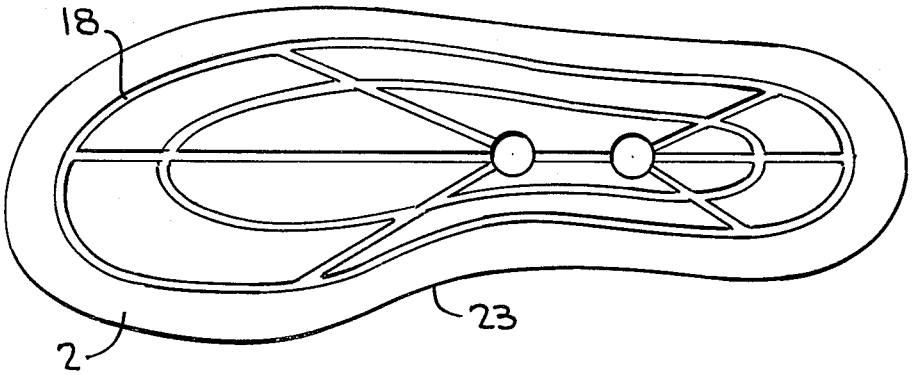
FIG. 11 is a view from above of the shoe base according to FIG. 9.

A particularly advantageous embodiment of the shoe base is shown in FIGS. 9 through 11, and is also independent of the nature of the construction, otherwise, of the upper and the shoe base. The shoe base 2 has two air passage holes 16, 17 in front of the heel 15. On the inside of the shoe, grooves 18 are provided in the shoe base 2, and are all connected to the passage holes 16, 17. Hence air can reach the underside of the foot during walking, via the passage holes 16, 17 and the grooves 18, preventing a build-up of perspiration. In practice, a pumping action even occurs during walking, so that air arrives within the shoe.

Although the passing holes 16, 17 are provided in the shoe upper 2 where this does not contact the street during walking, i.e., directly in front of the heel, there naturally exists the danger that in strong rainfall and in particular because of puddles, water penetrates into the shoe. In use on dusty paths, dust can also undesirably enter the shoe via the passage holes 16, 17. For this reason, blind holes 19, 20 of equal diameter are provided near the passage holes 16, 17, with plugs 21, 22 inserted into them. These plugs can be taken from the blind holes, 19, 20 and inserted into the passage holes 16, 17. The shoe base is then completely closed, so that no water can penetrate into it from below.

Figure 12:
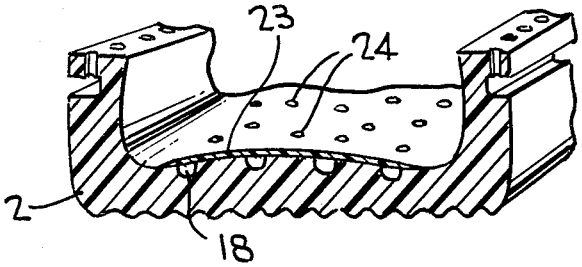
FIG. 12 is a cross section through the shoe base according to FIGS. 9 and 10.

FIG. 12 shows that the channels 18 can be covered above by a cover sole 23. This cover sole 23 has perforations 24, via which the air can reach the foot directly from the channels 18.

What is claimed:

1. A stitched-down shoe comprising an upper with an outwardly-turned edge and a base, said upper meeting said base at a stitching edge, said base having a seam groove laterally in the base and running near the upper edge of the base, and the stitch holes are directed to some extent perpendicularly into the seam groove, said outwardly turned edge of said upper being sewn directly to said base.

2. A stitched-down shoe according to claim 1, wherein the base of the shoe has a sole shaped to the foot.

3. A stitched-down shoe according to claim 1, wherein the shoe base has, at least partially, a raised, integral, foot-guiding edge.

4. A stitched-down shoe according to claim 3, wherein the foot-guiding edge is raised in the region of the heel to form a heel cap, and the heel of the shoe base is rounded in form, transverse of the plane of the shoe.

5. A stitched-down shoe according to claim 1, wherein the shoe base has a raised watertight edge on the inner side of the stitching edge.

6. A stitched-down shoe according to claim 1, further having an insole impregnated with an antimicrobial material inlaid in the shoe base, said insole being smaller than the contact surface of the foot on the shoe base.

7. A stitched-down shoe according to claim 1, 2, 3, or 4 further having an elastic T-shaped sealing strip inset between the shoe base and the upper on the stitching edge; the stitching running through the web of the strip, the base of which abuts the upper and the shoe base on the side toward the interior of the shoe.

8. A stitched-down shoe according to claim 1, wherein grooves are provided on the inside of the shoe in the shoe base, and are connected to at least one passage hole through the shoe base.

9. A stitched-down shoe according to claim 8, wherein the passage hole is provided in front of the heel of the shoe base.

10. A stitched-down shoe according to claim 8 or 9, wherein with each passage hole there is associated a blind hole with a removable plug to close the passage hole.

11. A stitched-down shoe according to claim 8 or 9, wherein the grooves are covered by a perforated cover sole in the interior of the shoe.

* * * * *